US011660646B2

(12) United States Patent
Faris, Jr. et al.

(10) Patent No.: US 11,660,646 B2
(45) Date of Patent: May 30, 2023

(54) FLUID DELIVERY SYSTEM AND METHOD

(71) Applicant: Oilmen's Truck Tanks, Inc., Spartanburg, SC (US)

(72) Inventors: John P. Faris, Jr., Spartanburg, SC (US); Robert J. Strong, Moore, SC (US); James H. Hill, III, Moore, SC (US)

(73) Assignee: OILMEN'S TRUCK TANKS, INC., Spartanburg, SC (US)

( * ) Notice: Subject to any disclaimer, the term of this patent is extended or adjusted under 35 U.S.C. 154(b) by 15 days.

(21) Appl. No.: 17/088,041

(22) Filed: Nov. 3, 2020

(65) Prior Publication Data

US 2022/0135394 A1 May 5, 2022

(51) Int. Cl.

| | |
|---|---|
| ***B08B 9/027*** | (2006.01) |
| ***B08B 9/032*** | (2006.01) |
| ***B67D 7/08*** | (2010.01) |
| ***B67D 7/78*** | (2010.01) |
| ***B67D 7/12*** | (2010.01) |

(Continued)

(52) U.S. Cl.

CPC ..... *B08B 9/0328* (2013.01); *B67D 7/04* (2013.01); *B67D 7/08* (2013.01); *B67D 7/12* (2013.01); *B67D 7/58* (2013.01); *B67D 7/78* (2013.01)

(58) Field of Classification Search

CPC ..... B08B 9/032; B08B 9/0328; B60S 5/02; B67D 7/08; B67D 7/12; B67D 7/58; B67D 7/78; B67D 7/36; B67D 7/62

See application file for complete search history.

(56) References Cited

U.S. PATENT DOCUMENTS 2,315,085 A * 3/1943 Churchward ..... A62C 25/005 222/14
3,706,413 A * 12/1972 Blum ..... B04B 15/00 141/90

(Continued)

FOREIGN PATENT DOCUMENTS

CN 110683504 A 1/2020
DE 19711937 C1 9/1998

(Continued)

OTHER PUBLICATIONS

WO2007087049 machine translation, Aug. 2007, BARTEC GMBH, all pages (Year: 2007).*

*Primary Examiner* — Nicolas A Arnett
(74) *Attorney, Agent, or Firm* — Dority & Manning, P.A.

(57) ABSTRACT

A fluid delivery system or method for the same may include features or steps for dispensing, via a nozzle, a first fluid from a first fluid storage tank of at least two fluid storage tanks. The fluid storage tanks may be separately fluidly coupled to a manifold via respective fluid supply lines. A fluid delivery line fluidly may couple the nozzle to the manifold. A residual first fluid may remain within the delivery line after the dispensing step. The system or method may further include features or steps for connecting the nozzle to a clearance tank. A clearance outlet line may fluidly couple the clearance tank to the manifold. The system or method may further include features or steps for purging the residual first fluid from the fluid delivery line into the clearance tank and delivering the residual first fluid from the clearance tank to the first fluid storage tank.

11 Claims, 3 Drawing Sheets

(51) Int. Cl.
*B67D 7/58* (2010.01)
*B67D 7/04* (2010.01)

(56) References Cited

U.S. PATENT DOCUMENTS 3,807,465 A * 4/1974 Ginsburgh ..... B67D 7/54 141/285
4,313,475 A * 2/1982 Wiggins ..... B05B 5/1641 141/192
5,421,903 A * 6/1995 Manabe ..... B08B 9/0933 134/40
5,685,396 A * 11/1997 Elkin ..... F01M 11/0458 123/196 R
5,878,767 A * 3/1999 Etling ..... F17C 9/00 137/15.01
6,296,026 B1 * 10/2001 Gregg ..... F17C 7/02 141/49
6,471,487 B2 * 10/2002 Keilty ..... G05D 7/0688 417/279
6,889,728 B2 * 5/2005 Kamikozuru ..... F17C 5/007 141/59
7,185,683 B2 * 3/2007 Hillam ..... B67D 7/085 141/94
7,628,182 B2 * 12/2009 Poulter ..... B67D 7/36 141/237
7,665,639 B2 2/2010 Kamikozuru
8,196,904 B2 * 6/2012 Boehm ..... B67D 7/06 261/76
10,150,663 B2 * 12/2018 Seay ..... G05D 7/0635
10,926,995 B2 * 2/2021 Seay ..... G05D 7/0635
2003/0164200 A1 * 9/2003 Czeranna ..... B62D 65/18 141/1
2009/0134171 A1 5/2009 Deberardinis
2010/0078835 A1 4/2010 Boehm

FOREIGN PATENT DOCUMENTS

DE 19733715 C1 9/1998
EP 1234714 A1 8/2002
EP 895960 B1 8/2003
JP 2015020748 A 2/2015
WO WO1998033675 A1 8/1998
WO WO2007087849 A1 8/2007

* cited by examiner

FLUID DELIVERY SYSTEM AND METHOD

FIELD

The present disclosure relates generally to fluid delivery systems. In particular, the present disclosure relates to a system and method for clearing a fluid delivery system.

BACKGROUND

Delivery of bulk fluids such as fuel, oil, kerosene, lubricating oil, etc. from a fluid delivery system is conventionally achieved by providing a tanker vehicle with a tank having a number of internal compartments or individualized storage tanks, each of which can hold a different bulk fluid. Typically, each of the storage tanks are connected to a manifold, and fluid can be pumped from one of the tanks to a downstream nozzle.

When an amount of fluid is to be delivered from one of the tanks to a receiving container, the appropriate tank is selected using a controller and the delivery line is connected to the receptacle into which the fluid is to be delivered. Operating a pump causes fluid to flow from the tank into the receiving container, often through a meter which records the amount of fluid delivered.

At the end of the delivery, the fluid delivery line is still filled with residual fluid from the previous delivery. In some cases, at least a portion of the residual fluid has already been recorded as being delivered by the meter.

When the fluid delivery system is to make a subsequent fluid delivery, if the liquid to be dispensed is different from that dispensed on the previous delivery, the fluid delivery line must first be emptied of the residual fluid and filled with the new liquid to be dispensed. This makes it difficult, if not impossible, to change fluid tanks without wasting the residual fluid trapped within the fluid delivery line. As such, an improved fluid delivery system is desired in the art. In particular, a fluid delivery system and method that reduces and/or entirely eliminates fluid waste when changing fluid tanks, is desired.

BRIEF DESCRIPTION

Aspects and advantages of the methods and systems in accordance with the present disclosure will be set forth in part in the following description, or may be obvious from the description, or may be learned through practice of the technology.

In accordance with one embodiment, a method for purging a fluid delivery system is provided. The method includes dispensing, via a nozzle, a first fluid from a first fluid storage tank of at least two fluid storage tanks. The at least two fluid storage tanks being separately fluidly coupled to a manifold via respective fluid supply lines. A fluid delivery line fluidly couples the nozzle to the manifold. A residual first fluid remains within the delivery line after the dispensing step. The method further includes connecting the nozzle to a clearance tank. A clearance outlet line fluidly coupling the clearance tank to the manifold. The method further includes purging the residual first fluid from the fluid delivery line into the clearance tank. The method also includes delivering the residual first fluid from the clearance tank to the first fluid storage tank.

In accordance with another embodiment, a fluid delivery system is provided. The fluid delivery system includes a manifold and a first fluid storage tank fluidly coupled to the manifold via a first fluid supply line. The system further includes a second fluid storage tank fluidly coupled to the manifold via a second fluid supply line. The fluid delivery system also includes a nozzle that is fluidly coupled to the manifold via a fluid delivery line. The nozzle is operable to dispense fluid from one of the first fluid storage tank or the second fluid storage tank. The fluid delivery system further includes a clearance tank fluidly coupled to the manifold via a clearance outlet line.

In accordance with yet another embodiment, a fluid delivery vehicle is provided, the fluid delivery vehicle includes a fluid delivery system mounted to the fluid delivery vehicle. The fluid delivery system operable to selectively dispense one or more fluids. The fluid delivery system includes a manifold and a first fluid storage tank fluidly coupled to the manifold via a first fluid supply line. The system further includes a second fluid storage tank fluidly coupled to the manifold via a second fluid supply line. The fluid delivery system also includes a nozzle that is fluidly coupled to the manifold via a fluid delivery line. The nozzle is operable to dispense fluid from one of the first fluid storage tank or the second fluid storage tank. The fluid delivery system further includes a clearance tank fluidly coupled to the manifold via a clearance outlet line.

These and other features, aspects and advantages of the present systems and methods will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present systems and methods, including the best mode of making and using the present systems and methods, directed to one of ordinary skill in the art, is set forth in the specification, which makes reference to the appended figures, in which.

DETAILED DESCRIPTION

Figure 1:
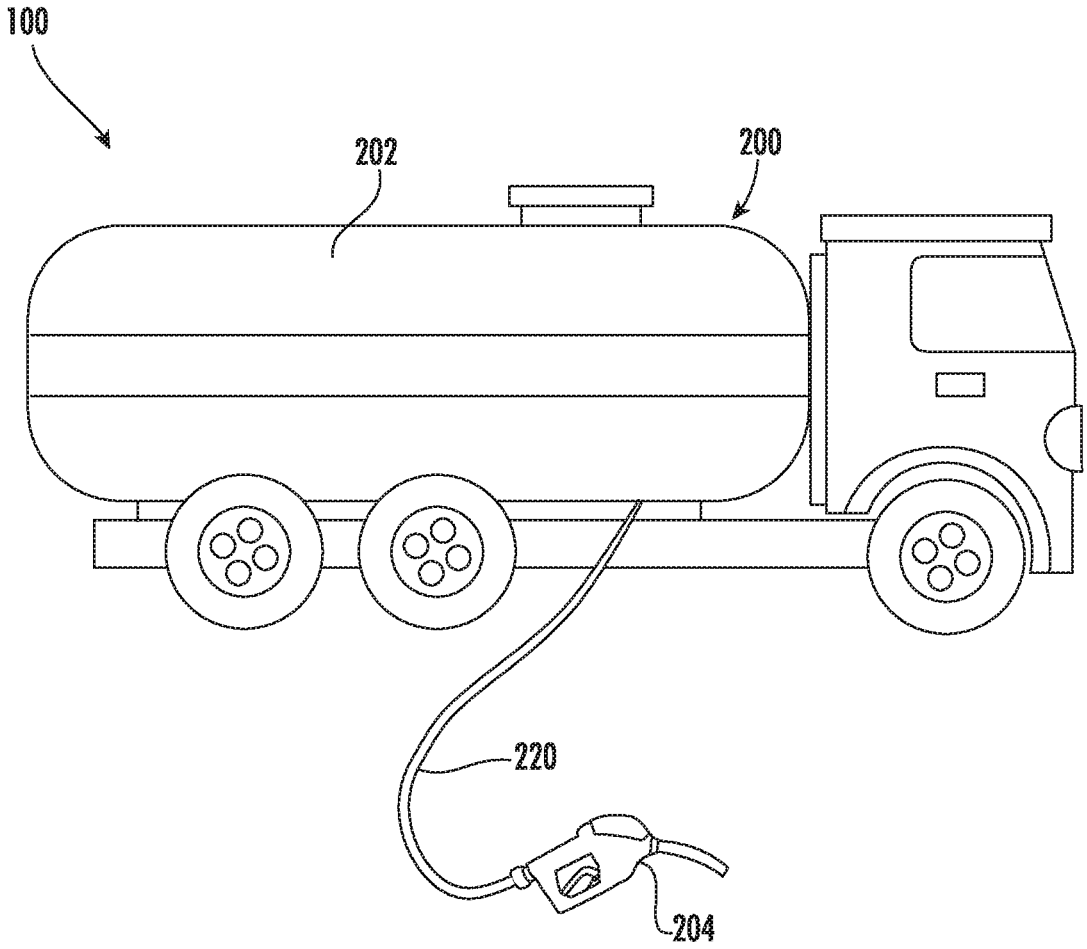
FIG. 1 is a schematic fluid delivery vehicle, which is equipped with a fluid delivery system, in accordance with embodiments of the present disclosure.

Reference now will be made in detail to embodiments of the present assemblies/systems/methods, one or more examples of which are illustrated in the drawings. Each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents.

The detailed description uses numerical and letter designations to refer to features in the drawings. Like or similar designations in the drawings and description have been used to refer to like or similar parts of the invention. As used herein, the terms "first," "second," and "third" may be used interchangeably to distinguish one component from another and are not intended to signify location or importance of the individual components.

As used herein, the terms "upstream" (or "forward") and "downstream" (or "aft") refer to the relative direction with respect to fluid flow in a fluid pathway. For example, "upstream" refers to the direction from which the fluid flows, and "downstream" refers to the direction to which the fluid flows. Terms of approximation, such as "generally," or "about" include values within ten percent greater or less than the stated value.

Referring now to the figures, FIG. 1 illustrates a schematic diagram of a fluid delivery vehicle or truck 100 (in some embodiments the vehicle 100 may be a van), which may be equipped with a fluid delivery system 200 capable of selectively dispensing one or more types of fluid. For example, the fluid delivery system 200 may be mounted or otherwise attached to the fluid delivery vehicle 100. As shown the fluid delivery system 200 may include one or more fluid storage tanks 202 attached to the chassis of the fluid delivery vehicle 100. In various embodiments, the one or more fluid storage tanks 202 may be internally partitioned into separate storage chambers, which may each contain a different fluid. In other embodiments, the one or more fluid storage tanks 202 may be a plurality of individualized tanks attached to the fluid delivery vehicle 100 or stored therein. Each fluid storage tank in the one or more fluid storage tanks 202 may contain or house a separate fluid, which may be delivered via a nozzle 204 in fluid communication with the fluid storage tanks 202. The fluid to be delivered may be selected using a controller (e.g., controller 232), which may be integral with the nozzle 204 or may be positioned on or within the truck 100.

Figure 2:
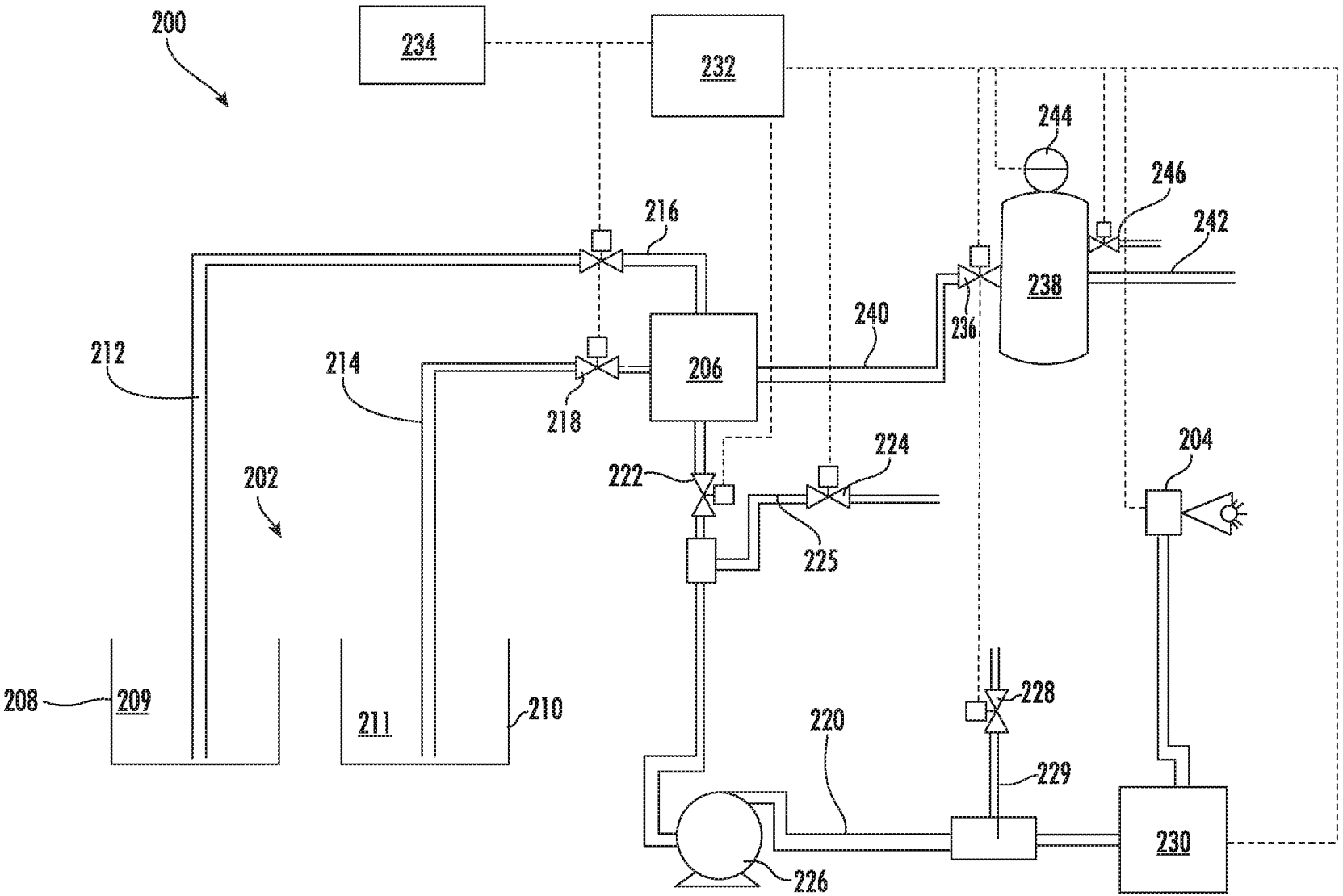
FIG. 2 illustrates a schematic diagram of a fluid delivery system, in accordance with embodiments of the present disclosure.

FIG. 2 illustrates a schematic diagram of the fluid delivery system 200, in accordance with embodiments of the present disclosure. As shown, the fluid delivery system 200 may include one or more fluid storage tanks 202 fluidly isolated from one another and separately fluidly coupled to a manifold 206. For example, the fluid delivery system 200 may include a first fluid storage tank 208 and a second fluid storage tank 210, which may contain different fluids or liquids such as fuel, oil, kerosene, lubricating oil, or other fluid. In particular embodiments, the first fluid storage tank 208 may contain or house a first fluid 209, and the second fluid storage tank 210 may contain or house a second fluid 211 that is different than the first fluid 209. Although only two fluid storage tanks 208, 210 are illustrated in FIG. 2, the fluid delivery system may include any number of fluid storage tanks separately fluidly coupled to the manifold 206, e.g., the system may include ten or more fluid storage tanks. In various embodiments, the system may include multiple manifolds, e.g., the system may include up to ten or more manifolds either separately or collectively coupled to one or more fluid storage tanks.

In many embodiments, the first fluid storage tank 208 may be fluidly coupled to the manifold 206 by a first fluid supply line 212, and the second fluid storage tank 210 may be fluidly coupled to the manifold 206 by a second fluid supply line 214. In many embodiments, multiple fluid supply lines may fluidly couple the storage tanks 208, 210 to the manifold 206. As used herein, the term "line" may refer to a hose, piping, or tube that is used for carrying fluid(s). For example, the fluid supply lines 212, 214 may each be in the form of a hose or pipe assembly that extends from the respective fluid storage tank 208, 210 to the manifold 206. In various embodiments, a first fluid supply valve 216 may be positioned in fluid communication on the first fluid supply line 212. For example, the first fluid supply valve 216 may be positioned on the first fluid supply line 212 between the first fluid storage tank 208 and the manifold 206. Similarly, a second fluid supply valve 218 may be positioned in fluid communication on the second fluid supply line 218. For example, the second fluid supply valve 218 may be positioned on the second fluid supply line 214 between the second fluid storage tank 210 and the manifold 206. In exemplary embodiments, the fluid supply valves 216, 218 may be selectively actuated between an open position and a closed position by a controller (e.g., controller 232). For example, one of the valves 216, 218 may be selectively opened to allow for flow of fluid from the respective fluid storage tank 208, 210 to the manifold 206. By contrast, when the fluid supply valves 216, 218 are in a closed position, the flow of fluid from the respective fluid storage tank 208, 210 is restricted or otherwise prevented.

In exemplary embodiments, the fluid delivery system 200 may include a nozzle 204 fluidly coupled to the manifold 206 via a fluid delivery line 220. the nozzle 204 operable to selectively dispense the first fluid 209 from the first fluid storage tank 208 or the second fluid 211 from the second fluid storage tank 210, e.g., into a receptacle or receiving container. In many embodiments, the fluid delivery system 200 may further include a fluid delivery valve 222, an air inlet valve 224, a pump 226, an air outlet ejection valve 228, and a meter 230 disposed in fluid communication with the fluid delivery line 220. As shown in FIG. 2, the fluid delivery valve 222 may be positioned on the fluid delivery line immediately downstream from the manifold 206, such that it is operable to prevent fluids from reaching the other components positioned on the fluid delivery line 220 when in a closed position.

In various embodiments, the air inlet valve 224 may be positioned on an air inlet line 225 that is fluidly coupled to the fluid delivery line 220 downstream from the fluid delivery valve 222 and upstream from the pump 226. The air inlet line 225 and valve 224 advantageously provide a means for flushing or clearing the fluid delivery line 220 after fluid from one of the storage tanks 208, 210 has been dispensed. For example, after a fluid has been dispensed from the nozzle 204, a residual amount of fluid may remain within the fluid delivery line 220. The residual fluid may be cleared by closing the fluid delivery valve 222, opening the air inlet valve 224, and operating the pump 226, thereby allowing a flow of air (e.g., either pressurized air or ambient air) to enter the fluid delivery line 220 and flush out the residual fluid. After such an operation, fluid delivery line 222 may be filed with air downstream of the fluid delivery valve 222.

In many embodiments, the air ejection valve 228 may be positioned on an air ejection line 229 that is fluidly coupled to the fluid delivery line 220 downstream from the pump 226 and upstream from the meter 230. The air ejection line 229 and valve 228 advantageously provide a means for flushing or clearing the air from the fluid delivery line 220. For example, after a first fluid 209 has been dispensed and the fluid delivery line 220 has been flushed or cleared of the first fluid 209 with air, the operator of the fluid delivery system 200 may desire to switch to dispensing a second fluid 211. In such case, the air that remains in the fluid delivery line may be ejected by the air ejection line 229. For example, the second fluid supply valve 218, the fluid delivery valve 222, and the air ejection valve 228 may be opened, while the other valves remain closed, and the pump 226 may be operated thereby ejecting the air from the fluid delivery line 220 until it is backfilled with the second fluid 211. At which point the air ejection valve 228 may be closed and the second fluid 211 may be dispensed by the nozzle 204 into one or more receptacles.

In many embodiments, the meter 230, such as a flowmeter or other suitable device for measuring the amount of liquid passing through the fluid delivery line 220, may be positioned immediately upstream from the nozzle 204. In some embodiments, the meter 230 may be integral with the nozzle 204. The meter 230 may function to measure the amount of fluid being dispensed by the nozzle 204, e.g., into a receptacle. In this way, the meter 230 may include one or more sensors in communication with a controller 232 that monitors an amount of fluid passing through the fluid delivery line 220, thereby allowing the controller 232 to calculate and track how much fluid has been dispensed from the storage tanks 208, 210. In some embodiments, the controller 232 may be in the form of a register directly coupled to the system 200.

In exemplary embodiments the fluid delivery system 200 further includes a clearance tank 238 fluidly coupled to the manifold 206 via a clearance outlet line 240. A clearance valve 236 may be positioned in fluid communication on the clearance outlet line 240. The clearance tank 238 may advantageously provide a means for recycling or storing the residual fluid that gets trapped within the delivery line 220 after one or more deliveries. For example, after an operator utilizes the fluid delivery system 200 to dispense a first fluid 209 from a first fluid storage tank 208 for one or more deliveries, a residual amount of first fluid 209 may be trapped within the fluid delivery line 220. To clear this residual first fluid 209 from the delivery line 220, the nozzle 204 may be attached, either directly or indirectly, to the clearance tank 238 and a clearance event may be executed on the system (e.g., by selecting the appropriate operation on the user interface 234). During the clearance event, all valves may be set by the controller 232 to a closed position with the exception of the air inlet valve 224, which will be set by the controller 232 to an open position. Operating the pump 226 may force all of the residual first fluid 209 out of the fluid delivery line 220 (e.g., by backfilling the fluid delivery line 220 with air provided by the air inlet valve 224) and into the clearance tank 238. This process may be repeated until the clearance tank 238 is filled with the residual first fluid 209, at which point the controller 232 may open the clearance valve 236 and the first fluid supply valve 216 and the clearance tank 238 may be emptied, thereby returning the residual first fluid 209 to its original first fluid storage tank 208.

In various embodiments, the nozzle 204 may be removably attached, either directly or indirectly, to the clearance tank 238 during a clearance event in which the fluid delivery line is flushed or cleared. For example, the nozzle 204 may be coupled directly to the clearance tank 238 or to a clearance inlet line 242. In other words, nozzle 204 may be fluidly coupled directly to the downstream clearance tank 238 or indirectly to the downstream clearance tank 238 through the clearance inlet line 242, which is upstream from the clearance tank 238 and downstream from the nozzle 204.

In many embodiments, the fluid delivery system 200 may include one or more sensors 244 attached to the clearance tank 238 for detecting the amount of fluid within the clearance tank 238. For example, the sensor 244 may be any suitable sensor for detecting the amount of fluid within a tank, such as but not limited to a float, displacer, bubbler, differential pressure transmitter, magnetic level gauge, capacitance transmitter, ultrasonic transmitter, laser level transmitter, radar level transmitter, or other.

In particular embodiments, the fluid delivery system 200 may include a vent valve 246 fluidly coupled to the clearance tank 238. The vent valve 246 may be selectively actuated between an open position and a closed position by the controller 232. In particular, the vent valve 246 may be selectively opened to allow air to pass to or from the clearance tank 238. For example, the vent valve 246 may be selectively opened to allow for air to be evacuated from the clearance tank 238 (such as evacuated into the atmosphere) while the tank is being filled with fluid by the nozzle 204. The air may be evacuated by the vent valve 246 while the clearance tank 238 is being filled with fluid until the sensor 244 detects that the clearance tank 238 is full. At which point, the vent valve 246 may be closed. When the vent valve 246 is in a closed position, the flow of air from the clearance tank 238 into the atmosphere is restricted or otherwise prevented.

As shown, the fluid delivery system 200 may include a user interface 234 that is operatively coupled to the controller 232 (e.g., electrically or wirelessly via a suitable communications line). The user interface 234 may allow a user to select which fluid (and corresponding fluid storage tank) the system is to dispense. In exemplary embodiments, the user interface 234 may be mounted or integral with the nozzle 204, such that a user may operate the entire system 200 from the nozzle 204. In other embodiments, the user interface 234 may be mounted or integral with the truck 100, or another suitable location.

Operation of fluid delivery system 200 may be generally controlled by a processing device or controller 232. The controller 232 may, for example, be operatively coupled to user interface 234 for user manipulation to select features and operations of the fluid delivery system 200, such as which fluid is to be dispensed or flushing/clearing operations. The controller 232 can operate various components of fluid delivery system 200, in order to dispense a desired fluid from the system and/or clear the fluid delivery line 220. In exemplary embodiments, the controller 232 is operably coupled (e.g., in electrical or wireless communication) with each of the valves, e.g., the first fluid supply valve 216, the second fluid supply valve 218, the fluid delivery valve 222, the air inlet valve 224, the air ejection valve 228, and the clearance valve 236. Thus, the controller 232 can selectively actuate and operate the first fluid supply valve 216, the second fluid supply valve 218, the fluid delivery valve 222, the air inlet valve 224, the air ejection valve 228, and the clearance valve 236 (e.g., based on signals received the user interface 234). Each of the valves may be selectively actuated by the controller 232 between an open position and a closed position. For example, one of the valves may be selectively opened to allow for flow of fluid through the respective line or piping to which it is attached. By contrast, when the valves are in a closed position, the flow of fluid through the respective line or piping to which the valve is attached may be restricted or otherwise prevented. Similarly, the pump 226 may be selectively operated by the controller 232 (e.g., based on signals received by the user interface 234). For example, the controller 232 may be operable to enable and disable the pump 226, thereby controlling the transfer of fluids within the system.

The controller 232 may include a memory and microprocessor, such as a general or special purpose microprocessor operable to execute programming instructions or microcontrol code associated with operation of the fluid delivery system 200. The memory may represent random access memory such as DRAM, or read only memory such as ROM or FLASH. In one embodiment, the processor executes programming instructions stored in memory. The memory may be a separate component from the processor or may be included onboard within the processor. Alternatively, the controller 232 may be constructed without using a microprocessor (e.g., using a combination of discrete analog or digital logic circuitry; such as switches, amplifiers, integrators, comparators, flip-flops, AND gates, and the like) to perform control functionality instead of relying upon software. In some embodiments, the system 200 may be controlled by pneumatics (such as pneumatic controls or a pneumatic system). One or more portions of the fluid delivery system 200 may be in communication with the controller 232 via one or more signal lines or shared communication busses (shown as dashed lines in FIG. 2). A battery pack (not shown) may be in electrical communication with controller 232 and other components to supply an electrical current thereto, as would be understood.

Figure 3:
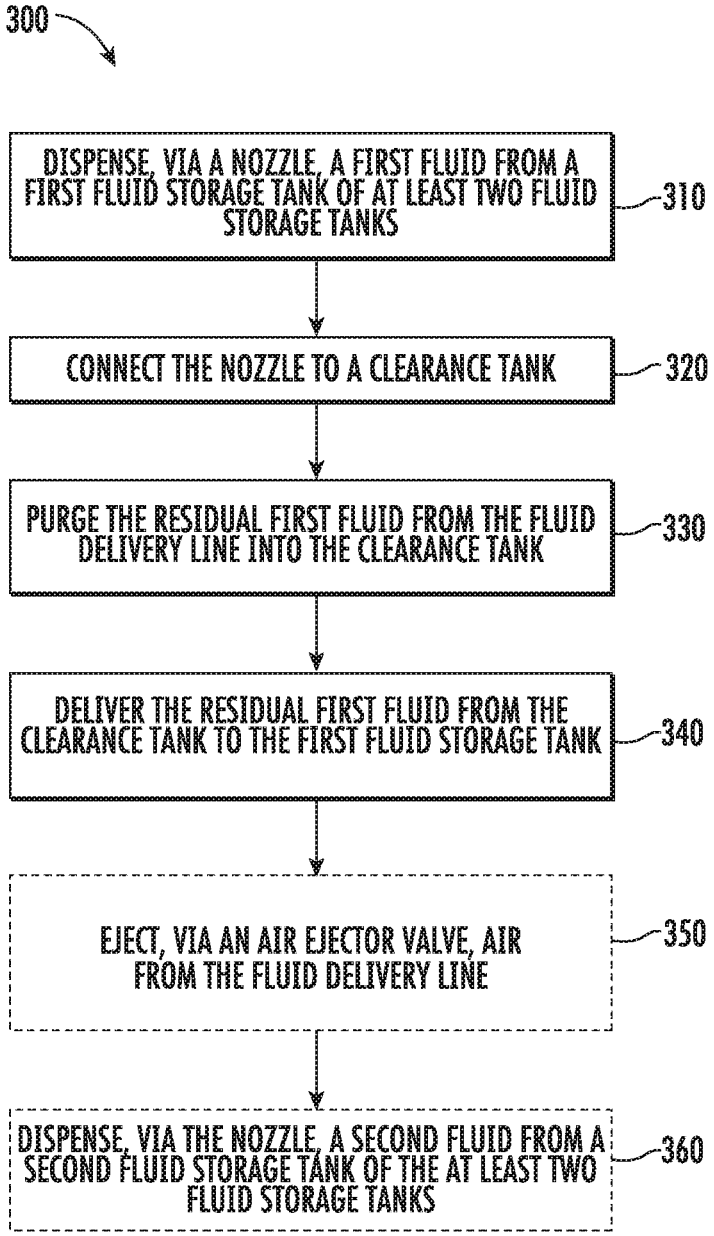
FIG. 3 is a flow chart of a method for purging a fluid delivery system, in accordance with embodiments of the present disclosure.

FIG. 3 is a flow chart of a sequential set of steps 310 through 360, which define a method 300 of for purging a fluid delivery system 200, in accordance with embodiments of the present disclosure.

As shown, the method may include a step 310 of dispensing, via the nozzle 204, a first fluid 209 from a first fluid storage tank 208 of at least two fluid storage tanks 208, 210. The at least two fluid storage tanks 208, 210 may be separately fluidly coupled to the manifold 206 via respective fluid supply lines 212, 214. As shown in FIG. 2, the fluid delivery line 220 fluidly couples the nozzle 204 to the manifold 206. After the first fluid 209 has been dispensed from the nozzle 204, a residual first fluid 204 remains within the delivery line 220. The method step 310 may be accomplished opening the first fluid supply valve 216 and the fluid delivery valve 222 and operating the pump 226 (e.g., to motivate fluid therethrough). For example, an operator of the system 200 may select, using the user interface 234, that they wish to dispense a first fluid 209 from the first storage tank 208. In response to the selection, the controller 232 may actuate the first fluid supply valve 216 and the fluid delivery valve 222 to an open position (e.g., while keeping all the other above-described valves in a closed position) and operate the pump 226, thereby providing a flow of first fluid 209 through the system 200 and out of the nozzle 204.

The method may further include a step 320 of connecting the nozzle 204 to a clearance tank 238, thereby providing fluid communication between the upstream clearance tank 238 and the downstream fluid delivery line 220. As described above, the nozzle 204 may be connected to the clearance tank 238 either directly or indirectly. For example, the nozzle 204 may be fluidly connected directly to the clearance tank 238 or to a clearance inlet line 242. As shown in FIG. 2, a clearance outlet line 240 fluidly couples the clearance tank 238 to the manifold 206.

In many embodiments, the method may further include a step 330 of purging the residual first fluid 209 from the fluid delivery line 220 into the clearance tank 238. The step 330 may include opening the air inlet valve 224, operating the pump 226, and dispensing the residual first fluid 209 from the fluid delivery line 220 into the clearance tank 238. As a result of step 330 a flow of air from the air inlet valve 224 may backfill the fluid delivery line 220. For example, an operator of the system 200 may select, using the user interface 234, that they wish to purge the residual fluid from the fluid delivery line 220 (this operation may be referred to as a clearance event). In response to the selection, the controller 232 may actuate the air inlet valve 224 to an open position (e.g., while keeping all the other above-described valves in a closed position) and operate the pump 226, thereby purging the residual fluid (e.g., a residual first fluid 209 trapped within the fluid delivery line 220 as a result of the dispensing operation) from the fluid delivery line 220 and into the clearance tank 238.

The method 300 may further include a step 340 of delivering the residual first fluid 209 from the clearance tank to the first fluid storage tank 208. For example, an operator of the system 200 may select, using the user interface 234, that they wish to deliver the residual first fluid 209 from the clearance tank 238 back to the original first tank 208. In response to the selection, the controller 232 may actuate the clearance valve 236, the air inlet valve 224, and the first fluid supply valve 216 to an open position (e.g., while keeping all the other above-described valves in a closed position) and operate the pump 226, thereby emptying the clearance tank 238 and returning the residual first fluid 209 back to the original first storage tank 208.

In some embodiments, the method 300 may include an optional step of accumulating the residual first fluid 209 within the clearance tank 238 by repeating the dispensing, connecting, and purging steps before performing the delivering step. In this way, the clearance tank 238 may store up residual first fluid before being emptied during the delivering step 340. In many embodiments, as shown in FIG. 2, the one or more sensors 244 attached to the clearance tank 238 may actively detect or monitor the level fluid within the clearance tank 238. In exemplary embodiments, delivering step 340 may end when the one or more sensors 244 detects that the tank 238 is empty (e.g., of liquid therein). In other words, the delivering step 340 may be halted in response to a signal detected at the one or more sensors 244 indicating the tank 238 is empty. For example, the sensor 244 may be in electrical communication (either wired or wireless) with the controller, and when the sensor 244 detects that the clearance tank 238 (i.e., liquid therein) has fallen below a predetermined level or has completely emptied, the controller 232 may close the corresponding valves and end the delivering step 340.

In optional embodiments, the method 300 may further include an optional step 360 of dispensing, via the nozzle 204, a second fluid 211 from a second fluid storage tank 210 of the at least two fluid storage tanks 208, 210. However, after the purging of the residual first fluid 209 from the fluid delivery line 220 in step 330, the fluid delivery line 220 may be filled with air. As such, the method 300 may further include an optional step 350 of ejecting, via an air ejector valve 228 (and/or vent valve 246 in some embodiments), air from the fluid delivery line 220. In exemplary embodiments, the steps 350 of ejecting the air and the step 360 of delivering a second fluid 211 may happen simultaneously. For example, an operator of the system 200 may select, using the user interface 234, that they wish to dispense a second fluid 211 from the second storage tank 210. In response to the selection, the controller 232 may actuate the second fluid supply valve 218 and the fluid delivery valve 222 to an open position (and in some cases the air ejection valve 228 may be opened if air remains in the fluid delivery line 220) (e.g., while keeping all the other above-described valves in a closed position) and operate the pump 226, thereby providing a flow of second fluid 211 through the system 200 and out of the nozzle 204. In some embodiments, the controller 232 may require that a predetermined volume of the second fluid 211 (e.g., as detected at the sensor 244) be supplied in the clearance tank 238 before the meter 230 is permitted to measure the amount of liquid (e.g., second fluid 211) passing through the fluid delivery line 220.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A method for clearing a fluid delivery system, the method comprising:

dispensing, via a nozzle, a first fluid from a first fluid storage tank of at least two fluid storage tanks, the at least two fluid storage tanks separately fluidly coupled to a manifold via respective fluid supply lines, wherein a fluid delivery line fluidly couples the nozzle to the manifold, wherein a residual first fluid remains within the delivery line after the dispensing step;

connecting the nozzle to a clearance tank, a clearance outlet line fluidly coupling the clearance tank to the manifold;

opening an air inlet valve, the air inlet valve positioned in fluid communication with the fluid delivery line upstream of the nozzle;

purging the residual first fluid from the fluid delivery line into the clearance tank, whereby air fills the fluid delivery line downstream of the air inlet valve to the nozzle; and delivering the residual first fluid from the clearance tank to the first fluid storage tank.

2. The method as in claim 1, wherein the fluid delivery line is filled with air after the purging step, and wherein the method further comprises ejecting the air via an air ejector valve.

3. The method as in claim 2, further comprising dispensing, via the nozzle, a second fluid from a second fluid storage tank of the at least two fluid storage tanks.

4. The method as in claim 3, wherein ejecting the air and dispensing the second fluid from the fluid storage system happens simultaneously.

5. The method as in claim 1, further comprising monitoring, via a meter, the amount of residual first fluid purged from the fluid delivery line into the clearance tank.

6. The method as in claim 1, wherein each of the respective fluid supply lines include a fluid supply valve in fluid communication therewith, wherein a fluid delivery valve and a pump are positioned in fluid communication on the fluid delivery line, and wherein a clearance valve is positioned in fluid communication on the clearance outlet line.

7. The method as in claim 6, wherein the dispensing step further comprises:

opening the fluid supply valve of the respective fluid supply line in fluid communication with the first fluid storage tank of the at least two fluid storage tanks;

opening the delivery valve; and operating the pump.

8. The method as in claim 6, wherein the purging step further comprises:

opening an air inlet valve, the air inlet valve positioned in fluid communication with the fluid delivery line downstream from the fluid delivery valve and upstream of the nozzle;

operating the pump; and dispensing the residual first fluid from the fluid delivery line with the nozzle into the clearance tank, whereby air fills the fluid delivery line.

9. The method as in claim 6, wherein the delivering step further comprises:

opening the clearance valve;

opening an air inlet valve, the air inlet valve positioned in fluid communication with the fluid delivery line downstream from the fluid delivery valve and upstream from the nozzle;

opening the fluid supply valve of the respective fluid supply line in fluid communication with the first fluid storage tank of the at least two fluid storage tanks; and operating the pump.

10. The method as in claim 1, further comprising detecting, with one or more sensors attached to the clearance tank, the amount of fluid within the clearance tank, wherein the delivering step ends when the one or more sensors detects that the tank is empty.

11. The method as in claim 1, further comprising repeating the dispensing step, the connecting step, the opening step, and the purging step until the clearance tank is filled with the first fluid, wherein the delivering step is performed once the clearance tank is filled with the first fluid.

* * * * *